United States Patent [19]

Rutigliano

[11] Patent Number: 4,962,581

[45] Date of Patent: Oct. 16, 1990

[54] BLADE SHEATH FOR USE IN CLEANING A MEAT SLICER BLADE AND METHOD OF USE THEREOF

[76] Inventor: Edmond P. Rutigliano, 2519 South Franklin St., Philadelphia, Pa. 19148

[21] Appl. No.: 196,315

[22] Filed: May 20, 1988

[51] Int. Cl.[5] ..... B08B 7/00; B26D 7/22

[52] U.S. Cl. ..... 29/426.1; 29/DIG. 7; 134/18; 134/32; 134/42; 83/478; 83/DIG. 1

[58] Field of Search ..... 83/478, 545, DIG. 1; 206/349, 389, 462, 53; 134/18, 32, 33, 42; 29/426.1, DIG. 7

[56] References Cited

U.S. PATENT DOCUMENTS

| | | | |
|---|---|---|---|
| 1,205,246 | 11/1916 | Mowry | 206/349 |
| 2,517,649 | 8/1950 | Frechtmann | 30/286 |
| 2,598,192 | 5/1952 | Poust | 206/349 |
| 2,601,426 | 6/1952 | Baumann | 206/349 |
| 2,918,165 | 12/1959 | Paulick, Jr. | 206/16 |
| 2,954,118 | 9/1960 | Anderson | 206/349 |
| 3,129,731 | 4/1964 | Tyrrell | 30/151 |
| 3,326,250 | 6/1967 | Kephart, Jr. | 143/32 |
| 3,921,798 | 11/1975 | Dean et al. | 206/53 |
| 4,070,941 | 1/1978 | Lorenz | 83/478 |
| 4,143,460 | 3/1979 | Shean | 30/382 |
| 4,186,634 | 2/1980 | Akczinski, Sr. | 83/478 |
| 4,246,818 | 1/1981 | McGraw, Jr. | 83/478 |

FOREIGN PATENT DOCUMENTS

| | | | |
|---|---|---|---|
| 2594375 | 8/1987 | France | 83/651 |

OTHER PUBLICATIONS

Data Processing Supplies Catalog, undated, p. 507, "Wright Line", Tape Seal Cartridge.

*Primary Examiner*—Hien H. Phan

*Attorney, Agent, or Firm*—Eckert Seamans Cherin & Mellott

[57] ABSTRACT

A blade sheath for the circular disk of a rotary slicer is a narrow strip of flexible, but abrasion resistant, material and includes a longitiudinal channel. The two sheath ends are joined by a clip and bail to form a continuous loop. When the blade is placed in the channel of the sheath and the bail and clip are in the locked position, the the cutting edge of the blade is completely covered and the the blade surface is exposed for cleaning.

1 Claim, 2 Drawing Sheets

BLADE SHEATH FOR USE IN CLEANING A MEAT SLICER BLADE AND METHOD OF USE THEREOF

BACKGROUND OF THE INVENTION

1. Field of the Invention

This invention relates to guards for the blades of cutting and similar articles, and in particular to slicing machine cleaning guards.

2. Description of the Prior Art

It is necessary with sharp tools or machines with sharp cutting edges to protect the user not only when the machine is in operation, but when the machine is being stored or cleaned. Of course the blade is kept as sharp as possible for effective slicing. The blade and blade area must also be accessible, either for use in cutting or for access during cleaning. To protect operators, blade guards and the like have been utilized which cover the cutting edge of tools and machine blades. An example of a simple guard is the type found in U.S. Pat. No. 2,517,649 to Frechtmann, which discloses a blade cover for a hand held carving knife. The guard is a rod with a slot into which the knife blade fits. U.S. Pat. No. 2,954,118 to Anderson shows a guard to be placed over a band-saw blade. The edges of a channel-shaped guard are forced apart and the blade is inserted between them. Both of these blade covers are intended to be used when the saws or knives are being stored or transported.

There are also blade guards available for the toothed cutting blades of chain saws, and the like, all intended to protect the user and/or the area in which the saw is placed when the saw is off and not being used. Most of these provide a channel-like guard to be hand manipulated over the blade itself. Because of the nature of chain saws, the guards are simple, elongated, channeled strips which are simply manually pushed over the teeth edge after use. Representative of these blade guards are U.S. Pat. No. 3,326,250 to Kephart, Jr. and U.S. Pat. No. 3,129,731 to Tyrrell. A similar guard for the chain of a chain saW is disclosed by Shean in U.S. Pat. No. 4,143,460.

There are also guards for rotary blades for table saws and the like which may be placed over the stored blades and also kept on when the blades are in place until time of use. In U.S. Pat. No. 2,918,165 to Paulick, Jr. a cutter guard is disclosed which has a split spring steel band for opening a circular protective structure made from a plurality of individual "shoes" to enclose edges of a cutter, the number of shoes varying according to the circumference of the cutter. Rotary disk blades are of that type often removed if it is necessary to clean the saw or other machine, which is done only infrequently.

Meat and cheese slicers having a sharpened disc blade are in common use. These slicers are razor sharp and they create unique cleaning problems. Food slicers must be cleaned frequently, sometimes after each use for purposes of hygiene and also to avoid transferring the flavor of one sliced food into slices of the next. The slicers are common in delicatessens for slicing cold cuts. The circular disk blade of a meat slicing machine of this type is often shielded against inadvertently cutting a user's fingers during use by a stationary guard on the slicing machine itself. A user is protected during a slicing operation i.e he properly uses the guard and the moving table supporting the meat to be sliced. For example, in U.S. Pat. No. 4,070,941 to Lorenz, a blade cover plate is interlocked to prevent operation of the blade unless the protective plate is in position.

Known stationary guards prevent access to the blade over relatively large areas. Accordingly, during cleaning, stationary guards must be removed. There is no alternative which will provide access to the blade and to those portions of the slicer machine obscured by the stationary blade guard. The user may feel secure in cleaning a slicer when the power is off, but it is just this time when many users become distracted and receive serious cuts. To avoid inadvertent cuts during cleaning, additional blade guards have been devised which fit over the blade edge during cleaning only. Among these are those disclosed in U.S. Pat No. 4,186,634 to Akczinski, Sr. and U.S. Pat. No. 4,246,818 to McGraw, Jr. which both provide circular covers with peripheral flanges to cover the blade edge. They both include center mounts for attaching the circular cover to the blade and cover an entire back side of the blade as well as the blade edge. When using such guards, the covered side of the blade cannot be cleaned.

Blades of various descriptions have been placed in temporary packages for transport, the packages having means disposed over the edge of the blade which are not easily cut through. Typically such covers resemble envelopes or flattened tubes that enclose all around the blade. In connection with the circular blades that are used on deli-type slicers, an envelope enclosure precludes mounting of the blade and therefore prevents use of the same cover for protection during transport as well as protection during cleaning of the installed blade. Moreover, the typical blade cover is relatively loose, there being no obvious need to avoid the clearances which allow relative motion of the blade and its packaging.

None of the aforesaid slicer blade guards employs a continuous channel-like guard which covers only the blade edge. One might anticipate problems with attaching a structure similar to the linear blade guard that fits only on the cutting edge, in particular that more cuts would be caused than avoided if users were required to hand manipulate a cover onto a slicer blade in the area of the razor sharp edge. Therefore it may not be surprising that the prior art lacks a circular channel guard for a disc blade, and in particular a circular channel guard which can be placed on the blade in an enlarged position and tightened by shortening its circumference once in place. A bail and clip for shortening a circular structure, such as used on tape reel covers or on spring-form cake pans, has likewise not been employed in the field of blade guards. Heretofore there has been no rotary slicer blade guard which is effective to cover only the blade edge of a slicer and leave the surfaces of the blade and surrounding slicer area uncovered for complete cleaning of a meat slicing machine. Nor has there been a blade guard which employs a bail-clip arrangement on a loop guard which can eliminate the need to manually press the guard over the blade edge and to provide a tightly fitting guard which will not slip off the blade.

SUMMARY OF THE DISCLOSURE

The aforementioned prior art problems are obviated by the blade sheath of this invention. A narrow strip of a generally flexible material defines in cross section a generally U-shaped longitudinal slot along the underside of the strip to form a channel-shaped sheath. The sheath has two ends connected together by a bail and clip to structure a continuous loop which is slightly larger than the blade's circumference when the bail is in its open position. The ends can be arranged to overlap. When the sheath is arranged at a blade edge, the bail and clip can be closed to circumferentially shorten the sheath, whereby the sheath is inherently forced radially downward onto the cutting edge, without further manual action by the user. The bail is also effectively secured to lock the sheath over the blade edge. The sheath covers only the blade edge, leaving the whole blade front and back surfaces unobscured for cleaning. The use of the bail and clip is a primary safety feature of the sheath because it allows a user to place the guard over the cutting edge of the blade without even having to press the cover down in place with his fingers. It is, therefore, an object of this invention to provide a blade guard which covers only the cutting edge of the blade of a slicing machine so that the blade surface and surrounding area of the slicing machine may be quickly and safely cleaned.

It is another object of this invention to provide a blade guard which is easily applied and removed without a user's hands or fingers touching portions of the blade itself.

It is a further object of this invention to provide a blade guard which is durable, impact resistant and moisture resistant.

It is yet another object of this invention to provide a blade edge guard which is self mounting and lockable over a circular blade edge.

It is still a further object of this invention to provide a blade guard which circumferentially expands and contracts for easy placement over a blade edge.

It is another object of this invention to provide a blade cover which clips into its locked position and does not require the user to apply pressure in a direction toward the blade edge, thus greatly reducing the risk of injury.

These and other objects will be more readily ascertainable to one skilled in the art from a consideration of the following Figures, description and exemplary embodiments, with the understanding that the drawings are illustrative only and that changes may be made in the specific construction illustrated and described within the scope of the appended claims.

BRIEF DESCRIPTION OF THE DRAWING(S)

FIG. *6a* is a partial perspective view of the blade sheath, showing an embodiment with overlapping ends on the strip portion.

FIG. *6b* is a partial perspective view of an alternative embodiment tot that of FIG. *6a*, the overlapping portions being integral extensions of the strip portion.

DETAILED DESCRIPTION OF THE PREFERRED EMBODIMENT(S)

Figure 1:
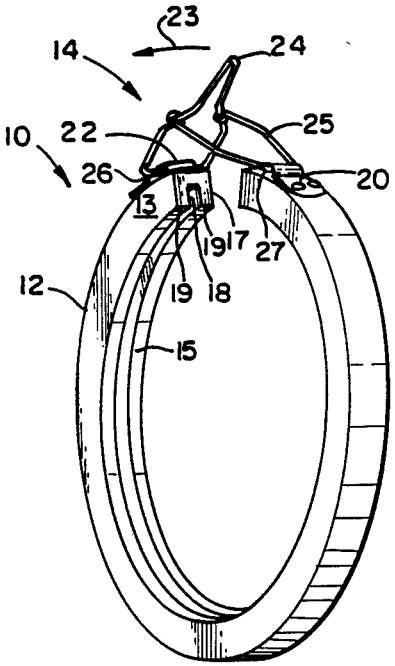
FIG. 1 is a perspective view of the blade sheath of this invention with the bail/clip connector in the open position.
Figure 2:
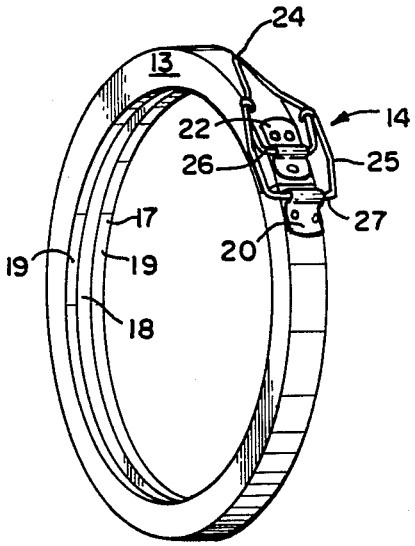
FIG. 2 is a perspective view of the blade sheath of this invention with the bail/clip connector in the closed position.

Referring now to the drawings, and more particularly to FIGS. 1 and 2, blade sheath 10 is illustrated in its open circumferentially enlarged position (FIG. 1) and in its closed circumferentially shortened position (FIG. 2). Sheath 10 has U-shaped strip 12 and connector 14. U-shaped strip 12 is shown with outer surface 13, sides 15 and ends 16 and 17 joined by connector 14. Underside 19 of strip 12 includes longitudinal channel !8 Which is defined by flange-like sides 15, 16 and the outer leg 13, together forming a generally U-shaped slot in strip 12. In FIG. 1, connector 14 is in the open position, ends 17 and 16 being spaced. In FIG. 2, connector 14 is closed and ends 17 and 16 are touching, the circumference of guard 10 being less than the circumference of guard 10 in open position, as illustrated in FIG. 1, and accordingly the strip 12 being positioned radially inwardly toward the blade axis by a corresponding amount. Clip 14 is seen to have bail 27 attached by plate 20 to strip end 17 and and clip 24 attached by plate 22 to strip end 16. When clip 24 is pushed in the direction of arrow 23, ends 16 and 17 are drawn together until they touch and guard 10 is locked firmly to a blade. The inside depth of the channel defined by strip 12 is related to the span of the bail closure and to the circumference of the blade. Assuming for example a blade radius of five inches (13 cm) and an inside depth (i.e., radial blade edge coverage) of one quarter inch (0.6 cm), the bail span from open to closed should be at least 1.6 inches (4 cm) such that the open circumference results in a strip radius greater than the blade radius by more than the depth of the strip channel.

Figure 3:
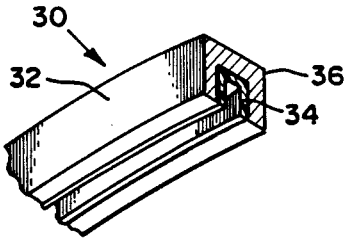
FIG. 3 is a partial cross section of an alternative embodiment of the strip portion of the blade sheath of this invention.
Figure 4:
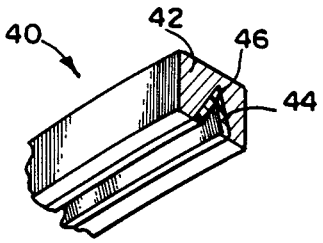
FIG. 4 is a partial cross section of an alternative embodiment of the strip portion of the blade sheath of this invention.

Now referring to FIGS. 3 and 4, two alternative embodiments of the strip of the blade guard are illustrated in cross section. Guard 30 (seen in FIG. 3) is generally U-shaped in cross section, the sides and base of the "U" forming right angles. Strip 30 has dual layers, outer layer 32 being preferably a flexible metal of appropriate thickness to permit bending into the required radius, and inner layer 34 being abrasion-resistant plastic to avoid dulling the cutting edge. Strip 40 (seen in FIG. 4) is generally U-shaped in cross section, but its innermost surface forms a V. Outer layer 42 is preferably flexible metal and inner layer 44 is preferably plastic.

Figure 5:
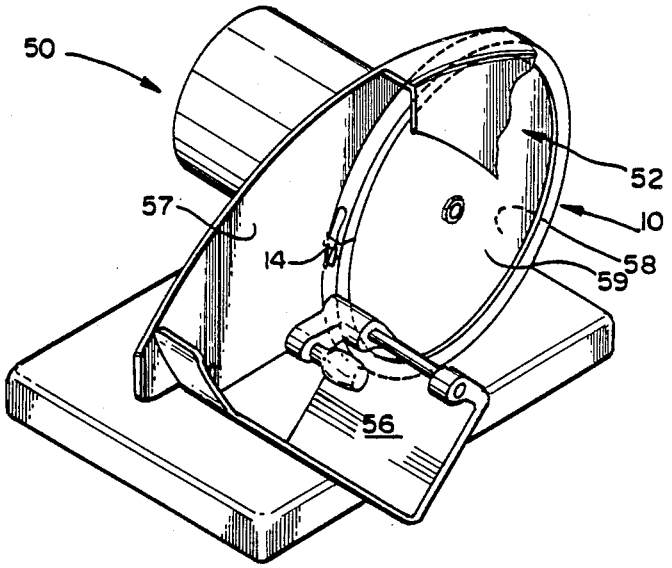
FIG. 5 is a perspective view of the blade sheath of this invention in place on the blade of a rotary slicing machine.
Figure 6A:
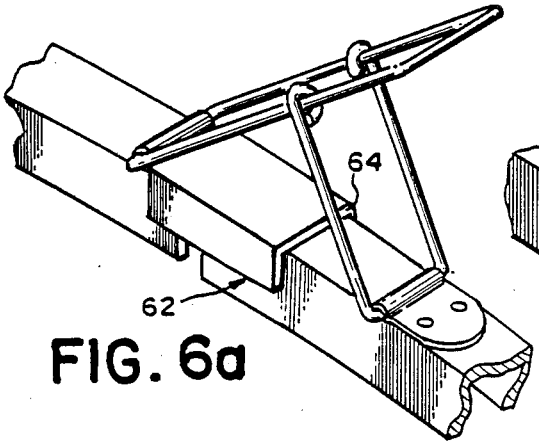
Figure 6B:
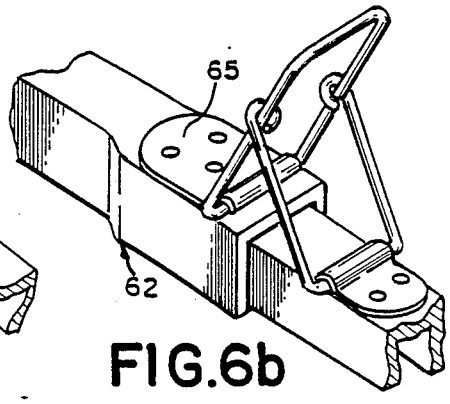

Now referring to FIG. 5, a meat and cheese slicer 50 is illustrated with blade 52 in position and covered by blade guard 10. In order to clean slicer 50, it is necessary to remove stationary guard 57, thus exposing the entire cutting edge of blade 52. Guard 10 is preferably placed onto blade 52 before guard 57 is removed. Removing guard 57 exposes both blade front 59 and blade rear 58, as well as table 56 and adjacent areas of slicer 50. Prior art blade guards covered blade rear 58, making it impossible to clean the entire blade in safety since the blade guard had to be removed in order to clean blade rear 58, thereby exposing the blade during a time of increased danger to the user. To clean a disc-shaped blade with the blade guard of this invention, a user positions the strip 12 at the periphery of the blade with the strip channel opened towards the blade edge. The bail connector 14, having bow shaped tabs at the ends, is closed by hinging one tab over on the strip, drawing the ends of the strip together and shortening the circumference defined by the strip and connector. The ends can be brought fully into abutment as in FIGS. 1 and 2, or alternatively, the ends can be arranged to merely approach or to overlap as in FIGS. *6a* and *6b*. In each case closing the bail foreshortens the circle defined by the device. Closing of the bail connector and the resulting circumferential shortening cause the strip to move radially towards the blade's center and lock into unmoving and protective position enclosing over the outermost part of the blade edge. The user does not touch the blade edge at all.

The bail connector according to the invention can be a captive loop type as shown in the drawings, or can be a type where one of the wire loops is only temporarily received on the opposed end of the strip. In this configuration, the loop can be removably captured under a flange facing away from the junction of the two ends. When the wire loop is separated from the flange, the two ends can be widely separated. It is presently preferred that the wire loops be captive, thereby minimizing the manual activities of the user near the blade's sharpened edge.

There are several variations which can be practiced in the scope of this invention. The strip may be a single or double layer, and still be within the scope of this invention. The strip may define in cross-section a U-shaped channel, which can be wide or narrow, and squared or rounded. The channel itself may also form a "V" on its inside or outside, or both. Of course, the sheath may be provided in appropriate thicknesses and lengths to fit all standard slicer blades.

The strip 12 and connector 14 together define a sheath circumference that is greater than the blade circumference by enough to allow the strip side walls to clear the blade when the connector 14 is open, whereby the opened sheath can be positioned at the blade edge. The circumference of the sheath is then shortened by the connector to pull the sheath down over the blade edge.

Connector 14 is preferably a bail clip as shown. Each end of the opposite ends of strip 12 is hinged to one of two tabs forming the bail clip connector 14. The two tabs are hinged to one another at a space from their hinged connection to the strip. Therefore, when one of the tabs is rotated away from the other of the tabs, around the hinged attachment of said one of the tabs to the strip, the ends of the strip are pulled toward one another.

A bail closure of this type can be made of metal or plastic and can have solid body tabs or wire bows defining tabs. In each case the closure is easily shortenable, making the entire sheath shortenable and adapted to be urged radially onto the blade edge without the user needing to exert pressure onto the blade edge and risking injury.

There are many advantages to the blade guard of this invention. Chiefly, the guard locks into place over the edge of a circular blade without obscuring any substantial area on the blade front or rear surfaces. It is not necessary for the user to press directly on the blade , even through the guard, when he is locking the guard in place. The blade guard safely covers the entire cutting area of the blade and protects the cleaner from being cut while he is cleaning a slicing machine.

FIGS. *6a* and *6b* illustrate two embodiments of the invention wherein even the area of the blade between the ends of the strip is protectively enclosed. In these embodiments, an enlarged terminal part 62 is fixed to one end of the strip and slidably receives the other end of the strip. The wire bow ends of the bail closure are spaced sufficiently that the bail clip spans over the terminal part 62, the latter guiding the relative motion of the two ends of the strip and protecting the user from contact with the blade even in the confined space between the two ends.

In FIG. *6a*, the terminal part 62 is a separate piece 64 of wider channel that is fixed to the outside of the strip at one end, for example by gluing, heat welding or the like. In FIG. *6b*, the terminal part 62 is an integral extension 65 of the strip, having been molded integrally with the strip, deformed by stretching the channel with application of heat, or the like. In each case, the terminal part helps to guide the ends of the strip during closure and to protect the user from cuts.

Having now illustrated and described my invention, it is not intended that such description limit this invention, but rather that this invention be limited only by reasonable interpretation of the appended claims.

What is claimed is:

1. A method for cleaning the blade of a rotary slicing machine, said machine including a housing, a rotatable circular disk blade, a stationary blade guard, and a table, said method comprising the steps of:

(a) disconnecting electric power from the machine;

(b) providing a slicer blade sheath, said sheath being a narrow strip of generally flexible material and generally U-shaped in cross section to form a channel-shaped sheath, said sheath having two ends and being of a length predetermined to span a circumference of the rotary slicer blade when said sheath ends are touching, whereupon flanged sides of the channel-shaped sheath extend radially inwardly from a cutting edge of the blade by a minimal amount, and a bail and clip connector attached to said sheath ends to cause said sheath to be continuous, the bail and clip connector having a span along the circumference of the blade;

(c) positioning said sheath around the circumference of said blade, said bail and clip being in an open position thereof, so that said sheath surrounds said blade edge;

(d) locking said sheath to said blade edge by closing said bail and clip connector, whereupon the sheath is shortened circumferentially by said span and drawn radially inward over the blade edge, by operation of the bail clip, the user's fingers remaining clear of the blade edge;

(e) removing said slicer's blade guard;

(f) cleaning said machine's table, moving parts and blade's surfaces, including axially-facing surfaces of said blade;

(g) replacing said blade guard;

(h) loosening said blade sheath by opening said bail and clip connector, whereupon the sheath clears the blade, the user's fingers remaining clear of said blade edge;

(i) removing said blade sheath from said blade.

* * * * *